US011430586B2

(12) United States Patent
Ma et al.

(10) Patent No.: US 11,430,586 B2
(45) Date of Patent: Aug. 30, 2022

(54) POST INSULATOR AND INSULATED SUPPORT POST

(71) Applicant: JIANGSU SHEMAR ELECTRIC CO., LTD., Nantong (CN)

(72) Inventors: Bin Ma, Nantong (CN); Jiang Fang, Nantong (CN); Chao Liu, Nantong (CN); Jie Yu, Nantong (CN); Guiyan Ni, Nantong (CN)

(73) Assignee: JIANGSU SHEMAR ELECTRIC CO., LTD., Nantong (CN)

( * ) Notice: Subject to any disclaimer, the term of this patent is extended or adjusted under 35 U.S.C. 154(b) by 124 days.

(21) Appl. No.: 17/041,068

(22) PCT Filed: Jan. 31, 2019

(86) PCT No.: PCT/CN2019/074283
§ 371 (c)(1),
(2) Date: Mar. 11, 2021

(87) PCT Pub. No.: WO2019/184596
PCT Pub. Date: Oct. 3, 2019

(65) Prior Publication Data

US 2021/0193351 A1 Jun. 24, 2021

(30) Foreign Application Priority Data

Mar. 27, 2018 (CN) ..... 201810260475.2

(51) Int. Cl.
*H01B 17/36* (2006.01)
*H01B 17/16* (2006.01)
*H01B 17/14* (2006.01)

(52) U.S. Cl.
CPC ..... *H01B 17/36* (2013.01); *H01B 17/14* (2013.01); *H01B 17/145* (2013.01); *H01B 17/16* (2013.01)

(58) Field of Classification Search
None
See application file for complete search history.

(56) References Cited

U.S. PATENT DOCUMENTS 4,217,466 A 8/1980 Technikag
4,246,696 A 1/1981 Technikag
(Continued)

FOREIGN PATENT DOCUMENTS

CN 1585046 A * 2/2005
CN 1851835 A 10/2006
(Continued)

OTHER PUBLICATIONS

English machine translation of Chen et al. (CN 1585046 A; family member CN 1331163 C is its published equivalent and the one translated); PDF accessed online from Espacenet, pp. 1-12 including the Drawings from original CN doc. (Year: 2005).*
(Continued)

*Primary Examiner* — Katie L. Hammer
(74) *Attorney, Agent, or Firm* — Seyfarth Shaw LLP

(57) ABSTRACT

Disclosed in the present invention is a post insulator, comprising a hollow insulating tube, a shed positioned on a periphery of the hollow insulating tube, and an upper flange and a lower flange provided at two ends of the hollow insulating tube, wherein gas is sealed inside of the hollow insulating tube, and the absolute pressure of the gas is 0.1-0.15 MPa. Further disclosed is an insulated support post formed by the end-to-end connection of the post insulators. The post insulator and the insulated support post of the present invention solve an interface problem present in internal insulating solid material filling, and also solve a gas leaking problem that occurs when using high-pressure gas filling, such that the post insulator does not need to be detected and maintained. At the same time, the margin of the
(Continued)

micro-water control range is improved, and micro-water control and production difficulty is reduced.

12 Claims, 10 Drawing Sheets

(56) References Cited

U.S. PATENT DOCUMENTS

| | | | | |
|---|---|---|---|---|
| 4,523,052 | A * | 6/1985 | Takahashi | H01B 17/28 174/31 R |
| 8,134,089 | B2 * | 3/2012 | Roseen | H01B 17/303 16/2.2 |
| 2001/0022235 | A1 * | 9/2001 | Villa | H01B 17/26 174/167 |
| 2009/0173515 | A1 * | 7/2009 | Sjoberg | H02G 15/06 174/12 BH |
| 2013/0025912 | A1 * | 1/2013 | Hoefner | H01B 17/14 174/156 |
| 2014/0000936 | A1 | 1/2014 | Emilsson | |
| 2014/0373602 | A1 * | 12/2014 | Holmberg | H01B 17/36 73/40.7 |

FOREIGN PATENT DOCUMENTS

| | | | |
|---|---|---|---|
| CN | 205943609 | U | 2/2017 |
| CN | 207021046 | U | 2/2018 |
| CN | 108257741 | A | 7/2018 |
| RU | 2119689 | C1 | 9/1998 |
| RU | 19607 | U1 | 9/2001 |
| RU | 2173902 | C1 | 9/2001 |
| RU | 2388184 | C2 | 4/2010 |
| RU | 2392678 | C1 | 6/2010 |
| RU | 130747 | U1 | 7/2013 |
| RU | 2635831 | C1 | 11/2017 |
| RU | 194013 | U1 | 11/2019 |
| WO | 9102039 | | 1/1991 |

OTHER PUBLICATIONS

Russian Office Action for Application No. 100,181 dated Feb. 8, 2021, 8 pages.

ABB Components Ed—ABB Components:, "Gas Insulated Wall Bushing, type GGFL, Installation and maintenance guide," vol. 2770 501-8 en, No. Rev. 3 Nov. 30, 2010, pp. 1-13, XP002655965. http://www05.abb.com/global/scot/scot252.nsf/veritydisplay/65148ddb16a0528cc12577f20038764d/$file/2770%20501-8%20%en%20rev%203.pdf [retrieved on Aug. 3, 2011].

European Search Report for corresponding Application No. 007729981 dated Nov. 10, 2021, 9 pages.

International Search Report for Application No. PCT/CN2019/074283, dated Apr. 17, 2019, 2 pages.

* cited by examiner

POST INSULATOR AND INSULATED SUPPORT POST

CROSS REFERENCE TO RELATED APPLICATIONS

This is a U.S. National Stage application of, and claims priority to, PCT/CN2019/074283, filed Jan. 31, 2019, which further claims priority to Chinese Patent Application No. 201810260475.2, filed Mar. 27, 2018, the disclosures of which are incorporated herein by reference in their entirety.

TECHNICAL FIELD

The present disclosure relates to a field of insulation devices for power transmission and transformation applications, and more particularly, to a post insulator and an insulated support post.

BACKGROUND

With the development and application of composite insulators, post insulators used in power equipment are mostly large-diameter composite insulators. The composite post insulator includes a hollow composite insulating tube and an insulating material filled in the insulating tube, so as to meet electrical and mechanical properties of the power equipment. In prior art, insulating material filling generally includes solid filling and gas filling. The solid filling generally refers to that a polyurethane material is filled in the hollow insulating tube, and the gas filling generally refers to that high-pressure nitrogen is filled in the hollow insulating tube.

However, the solid filling and high-pressure gas filling face practical problems that need to be solved urgently. Possible interface problems caused by solid filling will affect the electrical property of the post insulators. The hollow insulating tube filled with high-pressure nitrogen has certain internal gas leakage problems, so it needs regular inspection and maintenance. Moreover, the hollow insulating tube is filled with high-pressure insulating gas, the margin of the micro-water control range of the hollow insulating tube is small, and the control is difficult, leading to higher requirements for manufacturing.

SUMMARY

As for shortcomings in prior art, an object of the present disclosure is to provide a post insulator. The post insulator solves the possible interface problems caused by solid filling, and further solves the gas leakage problems caused by high-pressure gas filling, such that the post insulator is free from inspection and maintenance. Moreover, the margin of the micro-water control range is increased, and the difficulty of micro-water control and manufacturing is reduced.

For achieving the above object, the present disclosure adopts the following technical solution, that is, a post insulator includes a hollow insulating tube, a shed positioned on a periphery of the hollow insulating tube, and an upper flange and a lower flange provided at both ends of the hollow insulating tube. Gas is sealed inside the hollow insulating tube, and the gas has an absolute pressure in a range of 0.1 MPa to 0.15 MPa.

The absolute pressure of the gas inside the post insulator is set to 0.1 MPa to 0.15 MPa. The gas in a normal pressure state is not easy to leak, and thus there is no need to perform maintenance and inspection. Moreover, setting the absolute pressure of the filled gas at the normal pressure to be in a certain range can meet a pressure difference between different regions and between altitudes, so as to ensure that the gas inside the insulating tube is in a non-negative pressure state when used in different regions. Furthermore, the insulating tube filled with gas at the normal pressure has a large margin for micro-water control, which effectively reduces the difficulty of micro-water control and the difficulty of manufacturing.

In an embodiment, the hollow insulating tube is made of an insulating material having a water vapor transmission rate less than 0.2 $g/m^2 \cdot d$ at a temperature of 55° C. and a relative humidity of 90% RH.

Through making the hollow insulating tube of the insulating material having the water vapor transmission rate of 0.2 $g/m^2 \cdot d$ at the temperature of 55° C. and the relative humidity of 90% RH, it is verified by micro-water experiments that micro-water control indicators can be met, and water vapor content is low.

In an embodiment, the gas is dried high-purity nitrogen, air or sulfur hexafluoride gas.

Each of the high-purity nitrogen, air and sulfur hexafluoride gas has a good insulation property, is economical and practical, and contributes to reduce the manufacturing cost of the post insulator while ensuring the internal insulation property of the post insulator.

In an embodiment, the upper flange and/or the lower flange are provided with a self-sealing valve. The self-sealing valve is configured to backfill the gas after vacuuming.

Providing the self-sealing valve on the upper flange and/or the lower flange facilitates controlling the extraction and filling of the gas, and does not affect the electrical field inside the insulating tube. Moreover, the self-sealing valve is also used for leak detection and micro-water detection test in the factory.

In an embodiment, the lower flange includes a base configured to seal the hollow insulating tube and a flange tube fixed to a wall of the hollow insulating tube. The base or the flange tube is provided with the self-sealing valve.

In an embodiment, the self-sealing valve is positioned on the base. The base is recessed toward an interior of the insulating tube, such that an opening of the self-sealing valve is positioned inside a recess.

Positioning the opening of the self-sealing valve in the recess is convenient for the connection of a plurality of post insulators.

In an embodiment, the self-sealing valve is positioned on the flange tube. The flange tube is in communication with the hollow insulating tube via the base.

Through positioning the self-sealing valve on the flange tube, when a plurality of post insulators is connected, it is convenient to operate the self-sealing valve.

In an embodiment, the upper flange and/or the lower flange are provided with a drying device. The drying device is positioned inside the hollow insulating tube.

Providing the drying device inside the hollow insulating tube can keep the gas inside the insulating tube dry, and it is not easy to accumulate micro-water inside the insulating tube, thereby avoiding the problem of flashover inside the insulating tube.

In an embodiment, the drying device includes a cage-shaped desiccant box and desiccant placed in the desiccant box.

Further, the desiccant box is made of a conductive material, and is provided with a plurality of uniformly distributed through holes.

The cage-shaped desiccant box made of the conductive material and provided with the plurality of through holes can form a shielding cage structure. The principle of shielding cage can be used to ensure that the drying device will not affect an electric field inside the insulating tube.

Further, the desiccant is molecular sieve desiccant.

Another object of the present disclosure is to provide an insulated support post. The insulated support post can the provide insulation support for large electrical equipment. It can not only effectively solve the interface problem caused by filling solid material in the insulated support post, but also solve the gas leakage problem caused by filling high-pressure gas in the insulated support post, thereby avoiding detection and maintenance. Meanwhile, it can provide a large margin for micro-water control, and reduce the difficulty of micro-water control and manufacturing.

For achieving the above object, the present disclosure adopts the following technical solution, that is, an insulated support post includes two post insulators according to any post insulator as described above, the two post insulators being connected end to end.

In an embodiment, a sealing gasket is provided between the two post insulators.

Providing the sealing gasket between the two connected post insulators further ensures the sealing performance and reliability of the connection between the post insulators.

DETAILED DESCRIPTION OF THE EMBODIMENTS

As required, embodiments of the present disclosure are disclosed. However, it should be understood that the embodiments disclosed herein are merely typical examples of the present disclosure, which can be embodied in various forms. Therefore, the specific details disclosed here are not considered to be a limitation, but merely serve as a basis for claims and as a representative basis for teaching those skilled in the art to apply the present disclosure in any appropriate manner in practice, including the adopting various features disclosed herein and combining features that may not be clearly disclosed herein.

First Post Insulator Embodiment

Figure 1:
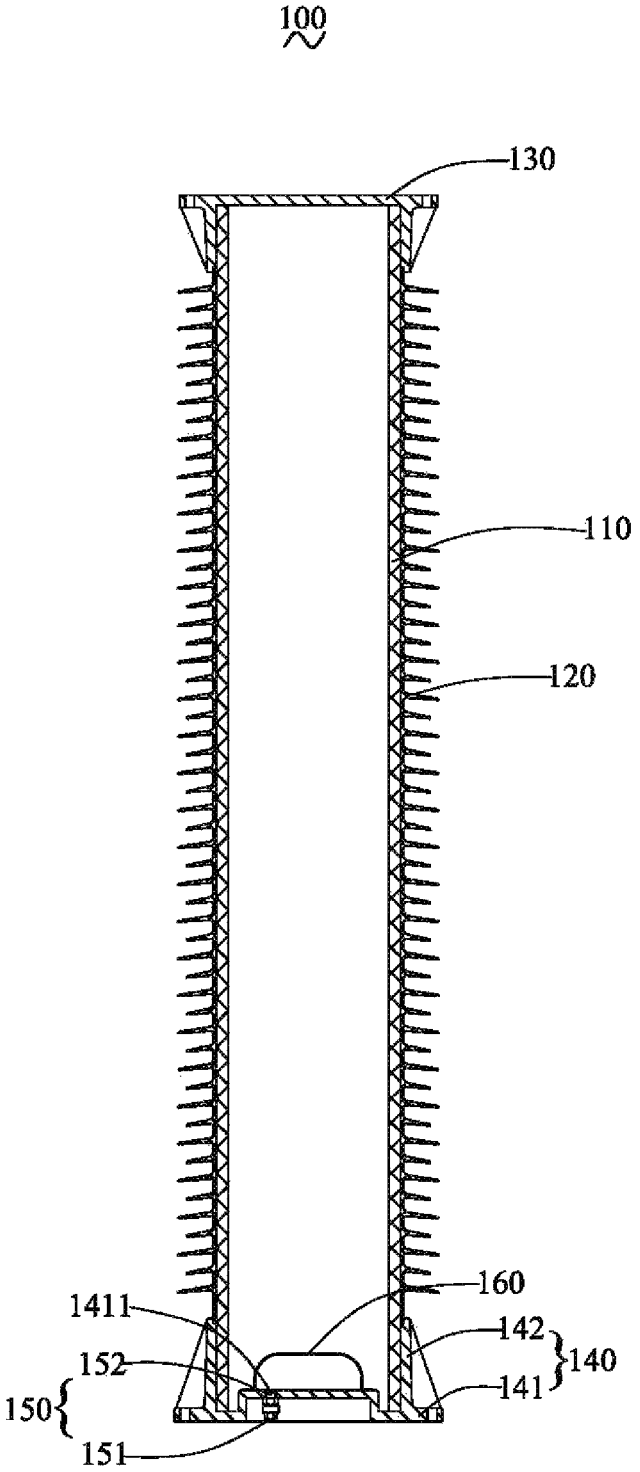
FIG. 1 is a schematic view showing a cross section in a longitudinal direction of a post insulator 100 according to a first post insulator embodiment of present disclosure.

As shown in FIG. 1, a post insulator 100 in this embodiment includes a hollow insulating tube 110, a shed 120 positioned on a periphery of the hollow insulating tube 110, and an upper flange 130 and a lower flange 140 provided at both ends of the hollow insulating tube 110. Gas is sealed inside the hollow insulating tube 110, and the gas has an absolute pressure in a range of 0.1 MPa to 0.15 MPa.

The absolute pressure of the gas in the post insulator 100 is set to 0.1 MPa to 0.15 MPa. The gas in the hollow insulating tube 110 is in a normal pressure state, and thus the gas is not easy to leak from the hollow insulating tube 110, so that the daily maintenance and inspection of the post insulator 100 is avoided. Setting the gas in the hollow insulating tube 100 to be in a normal pressure state can also meet a pressure difference between different regions and between altitudes, so as to ensure that the gas inside the hollow insulating tube 110 is in a non-negative pressure state when used in different regions. Furthermore, the hollow insulating tube 110 with a normal pressure inside has a large margin for micro-water control, which effectively reduces the difficulty of micro-water control and the difficulty of manufacturing.

It should be noted that, in this embodiment, the upper flange 130 and the lower flange 140 have the same structure. The upper flange 130 and the lower flange 140 are relative terms with regard to position, and no absolute limitation is made herein. The position and name of the upper flange and the lower flange can be adjusted according to actual needs.

The hollow insulating tube 100 may be made of an insulating material having a water vapor transmission rate less than 0.2 $g/m^2 \cdot d$ at a temperature of 55° C. and a relative humidity of 90% RH.

In this embodiment, the hollow insulating tube is formed by winding an insulating material having the water vapor transmission rate of 0.2 $g/m^2 \cdot d$ at the temperature of 55° C. and the relative humidity of 90% RH. It is verified by micro-water experiments that the hollow insulating tube 100 has low water vapor content, and micro-water control indicators can be met.

It should be noted that, in other embodiments, the hollow insulating tube may also be made of an insulating material having a water vapor transmission rate less than 0.2 $g/m^2 \cdot d$. The process of forming hollow insulating tube is not limited to the winding process.

The gas may be dried high-purity nitrogen, air or sulfur hexafluoride gas.

In this embodiment, the gas is dried high-purity nitrogen. High-purity nitrogen is a gas with a nitrogen content of 99.999%. The absolute pressure of the high-purity nitrogen in the hollow insulating tube 110 is controlled to 0.1 MPa, that is, one atmosphere.

High-purity nitrogen is an inert gas, used to fill the hollow insulating tube 110, and has the advantages of good insulation property, good stability, economy, practicality, and the like. The absolute pressure of the high-purity nitrogen in the hollow insulating tube 110 is controlled to one atmosphere, which is the same as the external pressure of the hollow insulating tube 110. In this way, it can effectively avoid the possibility of gas leakage.

It should be noted that, in other embodiments, the gas may also be air or sulfur hexafluoride gas, as long as the absolute pressure of the gas inside the insulating tube is in a range of 0.1 MPa to 0.15 MPa.

The upper flange 130 and/or the lower flange 140 may be provided with a self-sealing valve 150, which is used to backfill the gas after vacuuming.

In this embodiment, the lower flange 140 is provided with a self-sealing valve 150, such that it is convenient to control the extraction and filling of the gas. The self-sealing valve 150 can also be used for product leak detection and micro-water detection test in the factory.

It should be noted that, in other embodiments, the self-sealing valve may also be provided on the upper flange, or provided on both the upper flange and the lower flange. The number of self-sealing valves may also be more than one, and the position and number of self-sealing valves can be provided according to actual needs.

The lower flange 140 may include a base 141 and a flange tube 142. The base 141 is used to seal the hollow insulating tube 110. The flange tube 142 is fixed to a wall of the hollow insulating tube 110. The base 141 or the flange tube 142 may be provided with the self-sealing valve 150.

In this embodiment, the flange tube 142 of the lower flange 140 is perpendicular to the base 141. The base 141 closes an end surface of the hollow insulating tube 110. The flange tube 142 is connected to the wall of the hollow insulating tube 110. The self-sealing valve 150 is provided on the base 141. The upper flange 130 and the lower flange 140 have the same structure.

It should be noted that, in other embodiments, the self-sealing valve may also be provided on the flange tube. It is conceivable that when more than one self-sealing valve is provided on the post insulator, both the base and the flange tube can be provided with the self-sealing valve, or all the self-sealing valves are provided on the base or flange tube, which is not limited to herein.

The self-sealing valve 150 may be positioned on the base 141. The base 141 may be recessed toward an interior of the hollow insulating tube 110, such that an opening 151 of the self-sealing valve 150 is positioned inside a recess.

In this embodiment, the base 141 has a recess toward the interior of the hollow insulating tube 110. A height of the recess in a longitudinal direction is less than a height of the flange tube 142. A diameter of the recess in a transverse direction is less than a diameter of the hollow insulating tube 110.

The self-sealing valve 150 is provided on the recess of the base 141. Specifically, a connecting hole 1411 is provided on the base 141. A connecting end 152 of the self-sealing valve is threadedly connected to the connecting hole 1411 (not illustrated). Sealant (not illustrated) is provided between the connecting end 152 and the connecting hole 1411.

The self-sealing valve 150 is provided in the recess, and the opening 151 is positioned inside the recess, such that when two post insulators 100 are connected to each other, the self-sealing valve 150 on the lower flange 140 will not affect the connection between the two post insulators 100.

It should be noted that, in other embodiments, a size of the recess on the base may not be limited thereto. The base may be provided with no recess, and the self-sealing valve is directly positioned on the base. The connection between the self-sealing valve and the base is not limited to the threaded hole connection, and other connection methods such as welding, interference fit and the like may be adopted. The sealant may not be provided between the connecting end and the connecting hole, or other sealing methods may be adopted, and detailed description thereof will not be made herein.

A drying device 160 may be provided on the upper flange 130 and/or the lower flange 140. The drying device 160 may be positioned inside the hollow insulating tube 110.

In this embodiment, the drying device 160 is provided on the lower flange 140, and the drying device 160 is positioned inside the hollow insulating tube 110. Specifically, the drying device 160 is provided inside the hollow insulating tube 110 at a protruding portion corresponding to the recess of the base 141.

It should be noted that, in other embodiments, the drying device may not be provided on the protruding portion corresponding to the recess, but on a portion of the base that is not recessed. More than one drying device may be provided. The drying device may also be provided on the upper flange, or when a plurality of drying devices are provided, the drying devices can be provided on both the upper flange and the lower flange.

Second Post Insulator Embodiment

Figure 2:
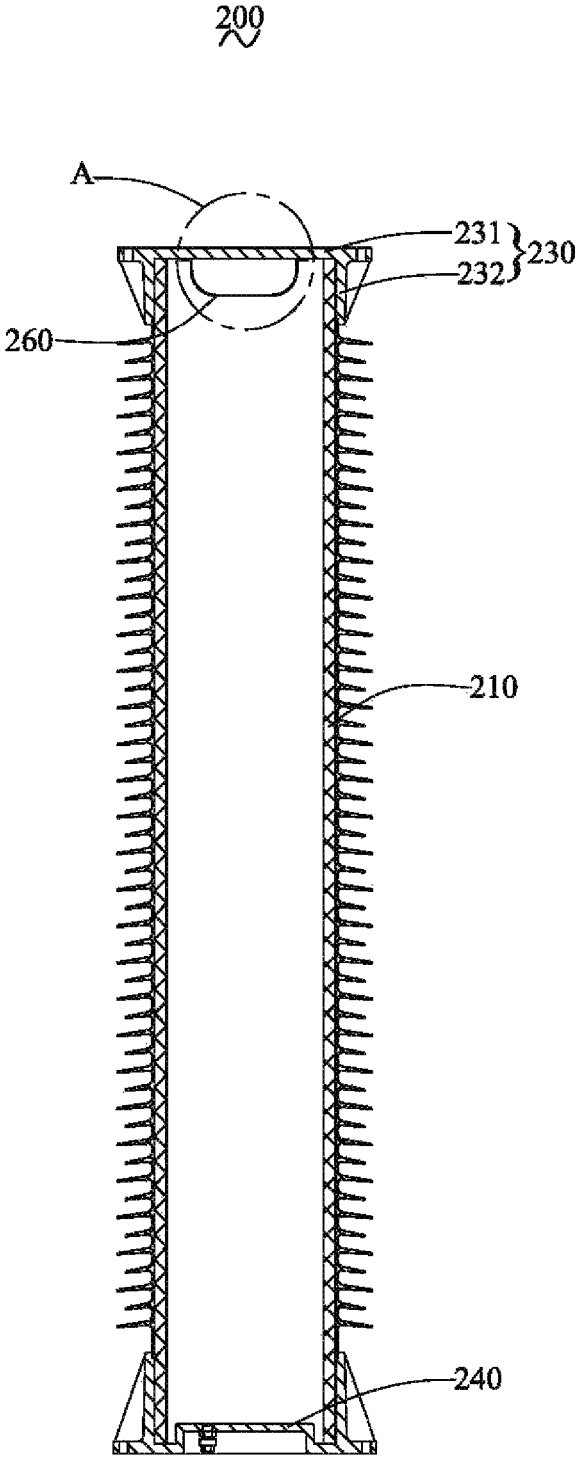
FIG. 2 is a schematic view showing a cross section in a longitudinal direction of a post insulator 200 according to a second post insulator embodiment of present disclosure.

As shown in FIG. 2, a post insulator 200 in this embodiment has a similar structure to that of the post insulator 100 in the first post insulator embodiment of the present disclosure. The same structure of the post insulator 200 as the post insulator 100 will not be repeated herein. The post insulator 200 differs from the post insulator 100 in that filled gas and absolute pressure inside the post insulator 200 in this embodiment is different from those of the post insulator 100. A drying device 260 is provided on an upper flange 230.

The gas may be dried high-purity nitrogen, air or sulfur hexafluoride gas.

In this embodiment, the gas is dried air. The absolute pressure in a hollow insulating tube 210 is controlled to 0.15 MPa.

The air has good stability, is economic and practical, and is filled inside the hollow insulating tube 210. The absolute pressure is controlled to 0.15 atmospheres, thereby effectively avoiding the gas leakage. In addition, the gas with slightly positive pressure can also adapt to the pressure difference between different regions and between altitudes, so as to ensure that a non-negative pressure is always maintained in the hollow insulating tube 210 in different regions.

It should be noted that, in this embodiment, the gas may also be sulfur hexafluoride gas, as long as the absolute pressure of the gas inside the insulating tube is in a range of 0.1 MPa to 0.15 MPa.

The upper flange 230 and/or a lower flange 240 may be provided with the drying device 260. The drying device 260 may be positioned inside the hollow insulating tube 210.

In this embodiment, one drying device 260 is provided on the upper flange 230. Specifically, the upper flange 230 and the lower flange 240 have the same structure. The upper flange 230 includes a base 231 and a flange tube 232. The drying device 260 is provided on base 231.

It should be noted that, in other embodiments, the drying device may also be provided on the lower flange. More than one drying device may be provided. When a plurality of drying devices is provided, the drying devices can be provided on both the upper flange and the lower flange.

The drying device 260 may include a cage-shaped desiccant box 261 and desiccant placed in the desiccant box 261.

Figure 3:
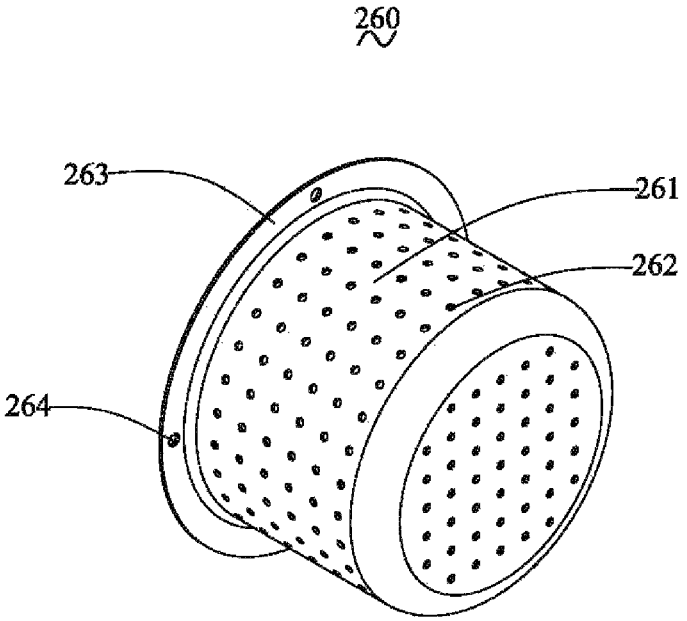
FIG. 3 is a perspective schematic view of a drying device 260.
Figure 4:
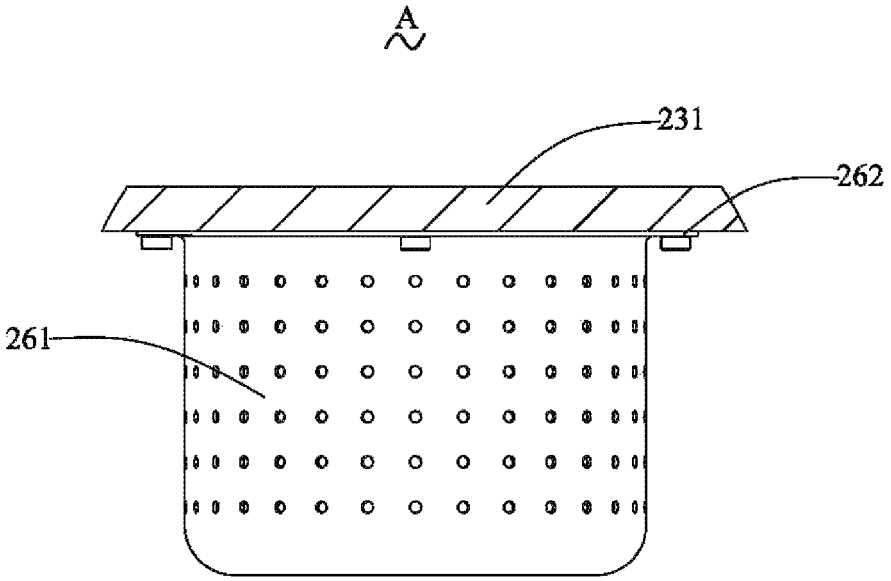
FIG. 4 is an enlarged schematic view of a portion A in FIG. 2.

In this embodiment, as shown in FIG. 3 and FIG. 4, the drying device 260 includes the desiccant box 261 and desiccant (not illustrated) placed in the desiccant box 261. The desiccant box 261 is cage-shaped. The desiccant box 261 is upside down on the upper flange 230, and the desiccant is placed in the desiccant box 261.

Specifically, the upper flange 230 closes an opening of the desiccant box 261. A height of the drying device 260 mounted on the base 231 in the longitudinal direction is less than that of the flange tube 232. A connecting lug 263 perpendicular to the desiccant box 261 extends from the opening of the desiccant box 261. A number of connecting holes 264 is provided on the connecting lug 263. The connecting hole 264 is used for fixed connection with the base 231 of the upper flange 230.

It should be noted that, in other embodiments, the drying device may also be fixed on the upper flange 230 in other ways, which are not limited to the connection method in this embodiment.

The desiccant box 261 may be made of a conductive material, and may be provided with a plurality of uniformly distributed through holes 262.

In this embodiment, the desiccant box 261 is made of metal material, and is provided with the plurality of uniformly distributed through holes 262 having uniform size.

The desiccant box 261 is cage-shaped, and provided with the plurality of uniformly distributed through holes 262 having a uniform size, thereby forming a shielding cage. Therefore, the principle of shielding cage is used to ensure that the desiccant box 261 will not affect an electric field inside the hollow insulating tube 210.

It should be noted that, in other embodiments, the conductive material and shape of the desiccant box are not limited thereto, and the distribution and size of the through holes are not limited thereto, as long as the requirements of the shielding cage can be met. A height of the drying device is not limited to be less than a height of the flange tube, and may also be slightly higher than that of the flange tube, as long as the principle of the shielding cage can be met by the drying device, that is, the drying device will not affect the electric field inside the hollow insulating tube.

The desiccant may be molecular sieve desiccant.

It should be noted that, in other embodiments, the desiccant may also be other types of desiccant.

Third Post Insulator Embodiment

Figure 5:
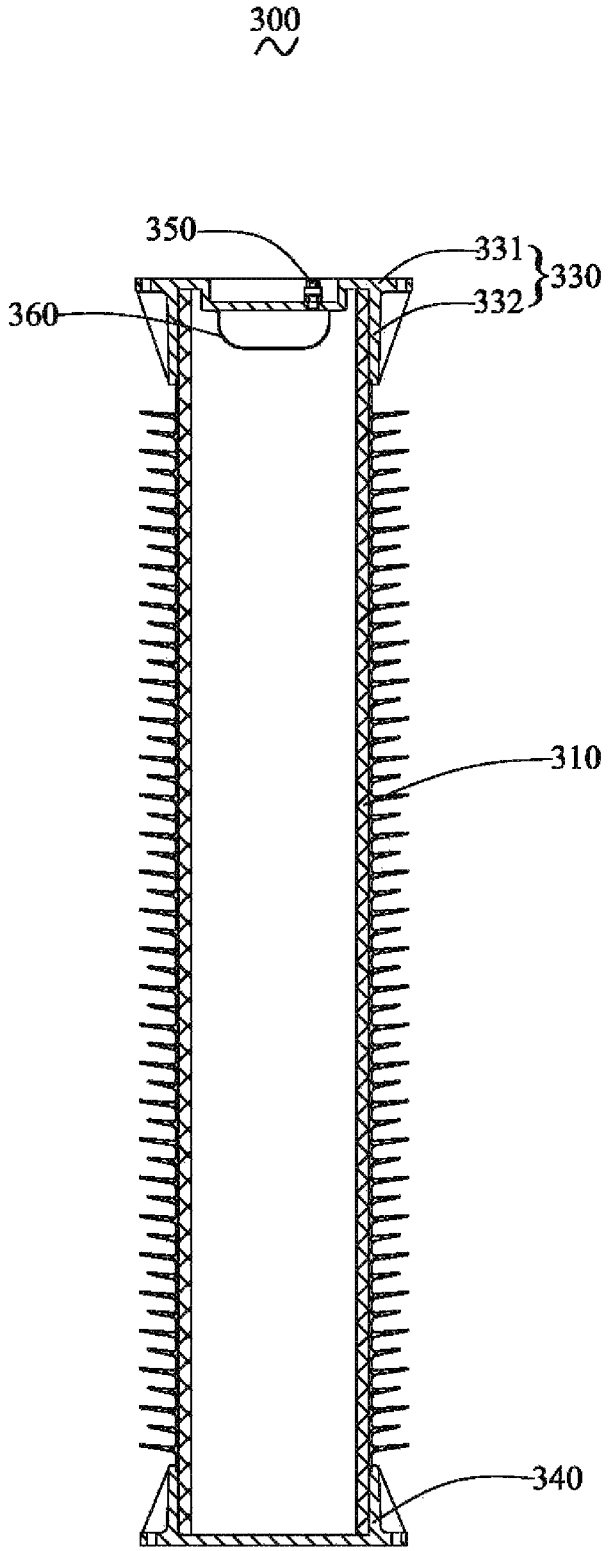
FIG. 5 is a schematic view showing a cross section in a longitudinal direction of a post insulator 300 according to a third post insulator embodiment of the present disclosure.

As shown in FIG. 5, a post insulator 300 in this embodiment has a similar structure to that of the post insulator 100 in the first post insulator embodiment of the present disclosure. A drying device 360 in this embodiment has the same structure as the drying device 260 in the second embodiment. The same structure of the post insulator 300 as the post insulator 100 will not be repeated herein. The post insulator 300 differs from the post insulators in the first and second embodiments in that a hollow insulating tube 310 in this embodiment is filled with 0.13 MPa sulfur hexafluoride gas. A self-sealing valve 350 and the drying device 360 are both provided on an upper flange 330.

The gas may be dried high-purity nitrogen, air or sulfur hexafluoride gas.

In this embodiment, the gas is dried sulfur hexafluoride gas. The absolute pressure inside the hollow insulating tube 310 is controlled to 0.13 MPa.

The upper flange 330 and/or a lower flange 340 may be provided with a self-sealing valve 350, which is used to backfill the gas after vacuuming.

In this embodiment, the self-sealing valve 350 is provided on the upper flange 330.

The lower flange 340 may include a base and a flange tube. The base is used to seal the hollow insulating tube 310. The flange tube is fixed to a wall of the hollow insulating tube 310. The self-sealing valve may be provided on the base or the flange tube.

In this embodiment, the upper flange 330 and the lower flange 340 have the same structure. Therefore, the upper flange 330 includes a base 331 and a flange tube 332. The flange tube 332 is perpendicular to the base 331. The base 331 closes an end surface of the hollow insulating tube 310. The flange tube 332 is connected to the wall of the hollow insulating tube 310. The self-sealing valve 350 is provided on the base 331.

It should be noted that, in other embodiments, the self-sealing valve may also be provided on the flange tube. The number of self-sealing valves is also not limited to one. When more than one self-sealing valve is provided, the self-sealing valves may also be provided on both the flange tube and the base. The position of the self-sealing valve can be set according to actual needs.

The self-sealing valve may be positioned on the base. The base may be recessed toward an interior of the hollow insulating tube 310, such that an opening of the self-sealing valve is positioned inside a recess.

In this embodiment, the self-sealing valve 350 is positioned on the base 331. The base 331 is recessed toward an interior of the hollow insulating tube 310, such that an opening of the self-sealing valve 350 is positioned inside a recess.

In this embodiment, the base 331 is provided with the recess. A height of the recess in the longitudinal direction is less than a height of the flange tube 332. A diameter of the recess in the transverse direction is less than a diameter of the base 331.

The opening of the self-sealing valve 350 is positioned inside the recess. When two post insulators 300 are connected, the self-sealing valve 350 positioned inside the recess will not affect the connection between the post insulators 300.

The upper flange 330 and/or the lower flange 340 may be provided with the drying device 360, and the drying device 360 may be positioned inside the hollow insulating tube 310.

In this embodiment, one drying device 360 is provided on the upper flange 330, and the drying device 360 is positioned inside the hollow insulating tube 310. Specifically, the drying device 360 is provided at a protruding portion corresponding to the recess of the base 331.

It should be noted that, in other embodiments, the drying device may not be provided on the protruding portion corresponding to the recess, but on a portion of the base that is not recessed. More than one drying device may be provided. The drying devices may be provided on both the upper flange and the lower flange, and detailed description thereof will not be made herein.

Fourth Post Insulator Embodiment

Figure 6:
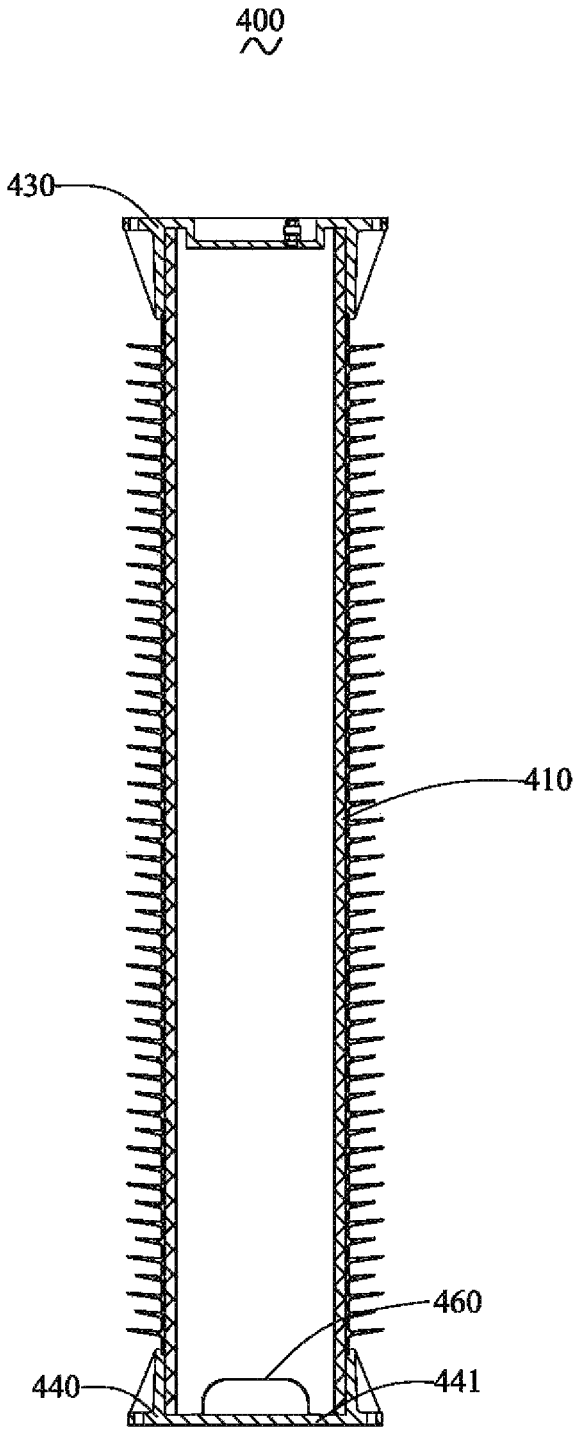
FIG. 6 is a schematic view showing a cross section in a longitudinal direction of a post insulator 400 according to a fourth post insulator embodiment of the present disclosure.

As shown in FIG. 6, a post insulator 400 in this embodiment has a similar structure to that of the post insulator 300 in the third post insulator embodiment of the present disclosure. A drying device 460 in this embodiment has the same structure as the drying device 260 in the second post insulator embodiment of the present disclosure. The same structure of the post insulator 400 as the post insulator 300 will not be repeated herein. The post insulator 400 differs from the post insulators 300 in that the drying device 460 in this embodiment is provided on a lower flange 440.

The drying device 460 may be provided on an upper flange 430 and/or the lower flange 440. The drying device 460 may be positioned inside a hollow insulating tube 410.

In this embodiment, the drying device 460 is positioned on the lower flange 440.

The drying device 460 may be provided on the upper flange 430 and/or the lower flange 440. The drying device 460 may be positioned inside the hollow insulating tube 410.

In this embodiment, one drying device 460 is provided on the lower flange 440, and the drying device 460 is provided in the hollow insulating tube 410. Specifically, the drying device 460 is provided on a base 441.

It should be noted that in other embodiments, the number of drying devices is not limited to one, and drying devices may also be provided on both the upper flange and the lower flange to meet actual needs.

Fifth Post Insulator Embodiment

Figure 7:
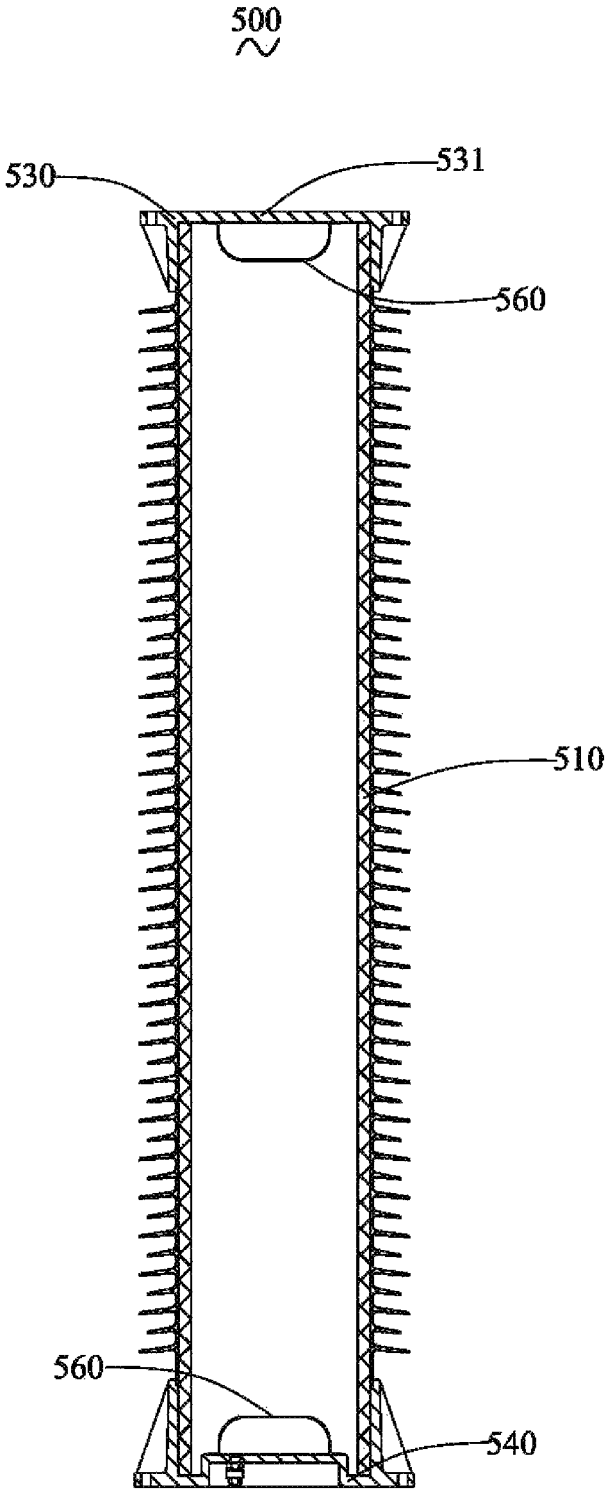
FIG. 7 is a schematic view showing a cross section in a longitudinal direction of a post insulator 500 according to a fifth post insulator embodiment of the present disclosure.

As shown in FIG. 7, a post insulator 500 in this embodiment has a similar structure to that of the post insulator 100 in the first post insulator embodiment of the present disclosure. The same structure of the post insulator 500 as the post insulator 100 will not be repeated herein. The post insulator 500 differs from the post insulators 100 in that an upper flange 530 is further provided with a drying device 560 in this embodiment.

The drying device 560 may be provided on the upper flange 530 and/or a lower flange 540, and the drying device 560 may be positioned inside a hollow insulating tube 510.

In this embodiment, one drying device 560 is provided on the lower flange 540, and the drying device 560 is positioned inside the hollow insulating tube 510. Another drying device 560 is further provided on the upper flange 530. Specifically, the drying device 560 is provided on a base 531, and the drying device 560 is positioned in the hollow insulating tube 510.

It should be noted that in other embodiments, the number of drying devices may be more than two, which can be set according to the actual size and needs of the post insulator.

Sixth Post Insulator Embodiment

Figure 8:
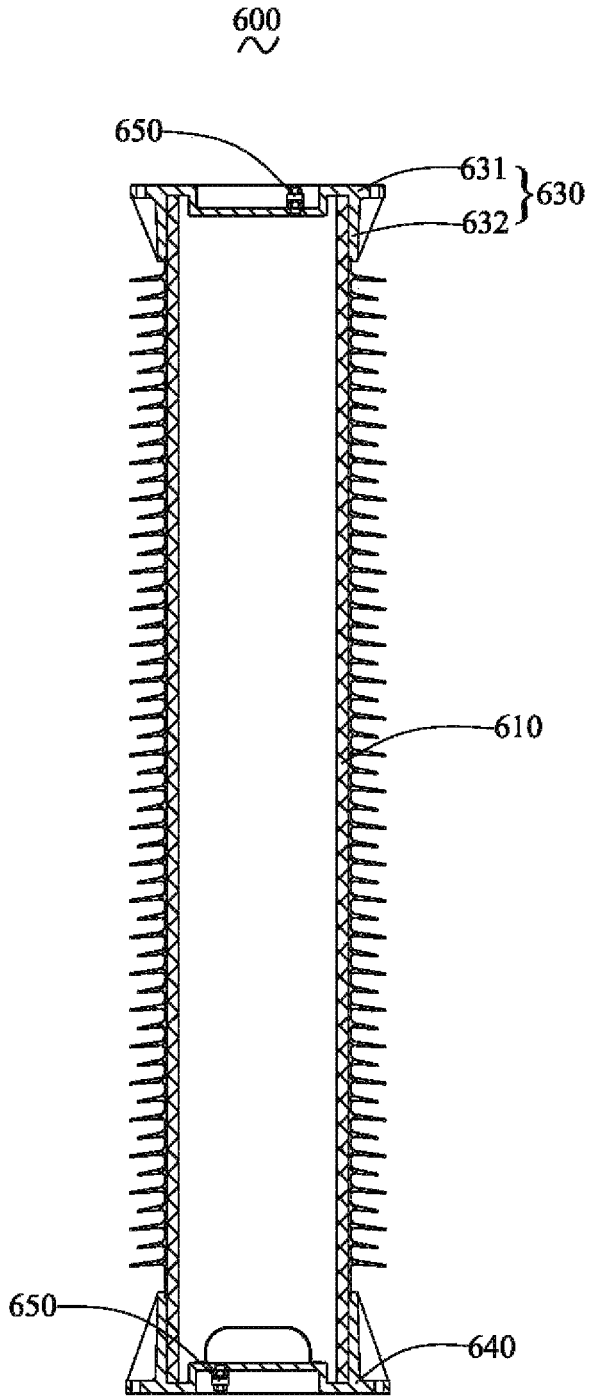
FIG. 8 is a schematic view showing a cross section in a longitudinal direction of a post insulator 600 according to a sixth post insulator embodiment of the present disclosure.

As shown in FIG. 8, a post insulator 600 in this embodiment has a similar structure to that of the post insulator 200 in the second post insulator embodiment of the present disclosure. The same structure of the post insulator 600 as the post insulator 200 will not be repeated herein. The post insulator 600 differs from the post insulators 200 in that an upper flange 630 is further provided with a self-sealing valve 650 in this embodiment.

The self-sealing valve 650 may be provided on the upper flange 630 and/or a lower flange 640, and the self-sealing valve 650 may be used to backfill the gas after vacuuming.

In this embodiment, one self-sealing valve 650 is provided on the upper flange 630, and another self-sealing valve 650 is provided on the lower flange 640.

The lower flange 640 may include a base and a flange tube. The base is used to seal a hollow insulating tube 610. The flange tube is fixed to a wall of the hollow insulating tube 610. The base or the flange tube may be provided with the self-sealing valve 650.

The self-sealing valve 650 is positioned on the base. The base is recessed toward an interior of the hollow insulating tube 610, such that an opening of the self-sealing valve is positioned inside a recess.

In this embodiment, the upper flange 630 and the lower flange 640 have the same structure. Therefore, the upper flange 630 includes a base 631 and a flange tube 632. The flange tube 632 is perpendicular to the base 631. The base 631 closes an end surface of the hollow insulating tube 610. The flange tube 632 is connected to the wall of the hollow insulating tube 610. The base 631 is provided with the self-sealing valve 650.

Furthermore, the self-sealing valve 650 is positioned on the base 631, and the base 631 is recessed toward an interior of the hollow insulating tube 610, such that an opening of the self-sealing valve 650 is positioned inside a recess.

In this embodiment, the recess is formed on the base 631. A height of the recess in the longitudinal direction is less than a height of the flange tube 632. A diameter of the recess in the transverse direction is slightly less than a diameter of the base 631.

The opening of the self-sealing valve 650 is positioned inside the recess, such that when two post insulators 600 are connected, the self-sealing valve 650 on the upper flange 630 is prevented from affecting the connection between the post insulators.

It should be noted that, in other embodiments, in order to facilitate air extraction and release, the self-sealing valve may also be provided on the flange tube. The number of self-sealing valves may not be more than one, and the position and number of self-sealing valves can be set according to actual needs.

Seventh Post Insulator Embodiment

Figure 9:
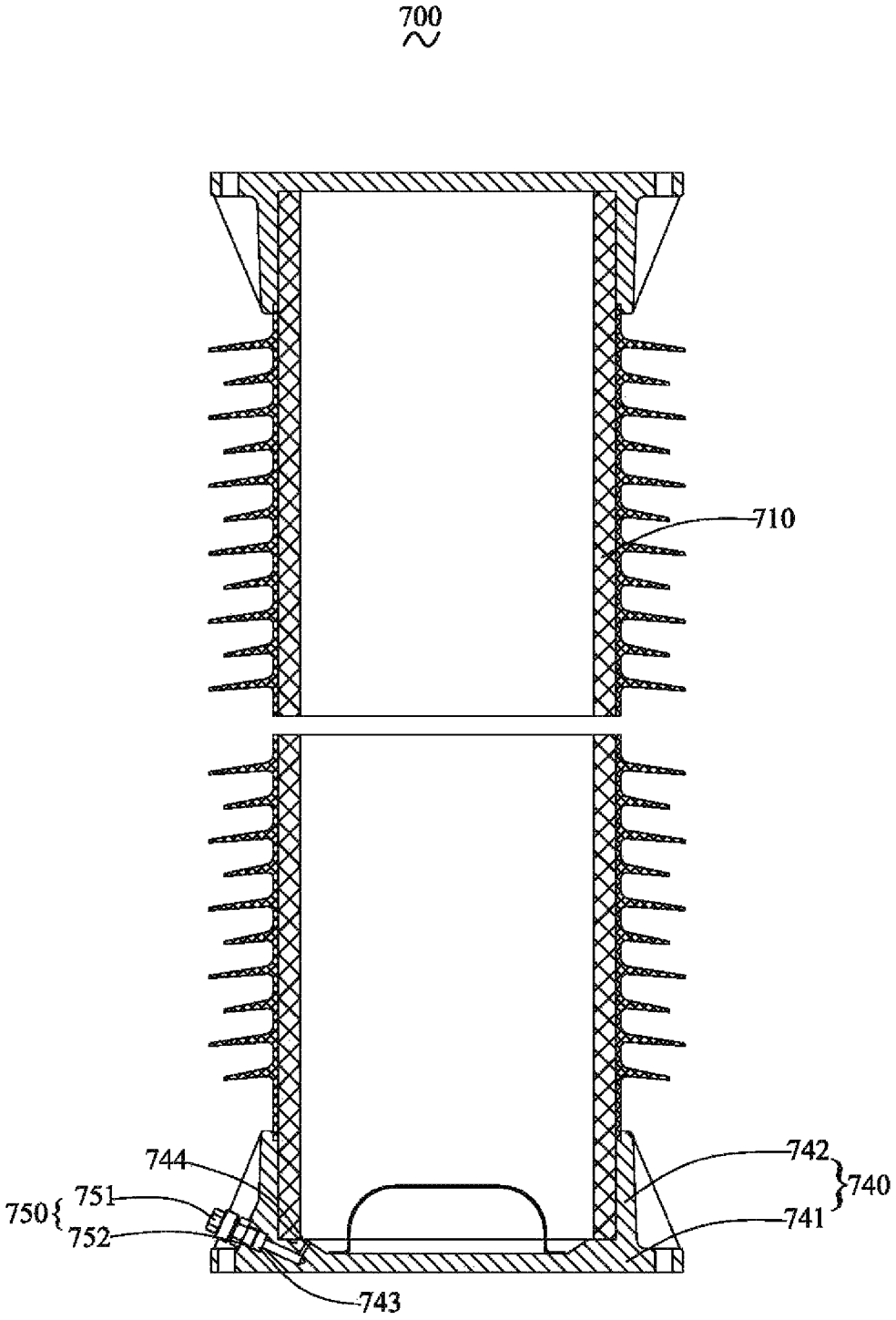
FIG. 9 is a schematic view showing a cross section in a longitudinal direction of a post insulator 700 according to a seventh post insulator embodiment of the present disclosure.

As shown in FIG. 9, a post insulator 700 in this embodiment has a similar structure to that of the post insulator 100 in the first post insulator embodiment of the present disclosure. The same structure of the post insulator 700 as the post insulator 100 will not be repeated herein. The post insulator 700 differs from the post insulator 100 in that a self-sealing valve 750 is provided on a flange tube 742 of a lower flange 740 in this embodiment.

The self-sealing valve 750 may be positioned on the flange tube 742. The flange tube 742 may be in a communication with a hollow insulating tube 710 via a base 741.

In this embodiment, the lower flange 740 includes the base 741 and the flange tube 742. The self-sealing valve 750 is provided on the flange tube 742 at an angle of 60 degrees to the longitudinal direction.

An opening 751 of the self-sealing valve 750 is provided outside the post insulator 700. The flange tube 742 is provided with a threaded hole 743. A connecting end 752 of the self-sealing valve 750 is threadedly connected to the threaded hole 743. The base 741 is provided with a hole 744 communicating the interior of the hollow insulating tube 710 with the threaded hole 743. The threaded hole 743 and the hole 744 are provided at an angle.

The self-sealing valve 750 is provided on the flange tube 742, and thus when a plurality of post insulators 700 is connected, the gas extraction and filling will not be affected. The threaded hole 743 is provided on the flange tube 742, and the hole 744 provided at an angle to the threaded hole 743 is provided on the base 741, so as to communicate the self-sealing valve 750 with the interior of the hollow insulating tube 710.

If the self-sealing valve 750 is directly connected to the interior of the hollow insulating tube 710 from the flange tube 754, wall thickness and height of the flange tube 742 need to be increased, thereby increasing the weight and cost of the flange 740. In this embodiment, the self-sealing valve 750 is in communication with the hollow insulating tube 710 through the threaded hole 743 and the hole 744 that are communicated at an angle, thereby effectively reducing the weight of the flange 740 and reducing the cost.

It should be noted that in other embodiments, the number of self-sealing valves is not limited to one. Naturally, according to actual needs, self-sealing valves may be provided on both the base and the flange tube.

First Insulated Support Post Embodiment

Figure 10:
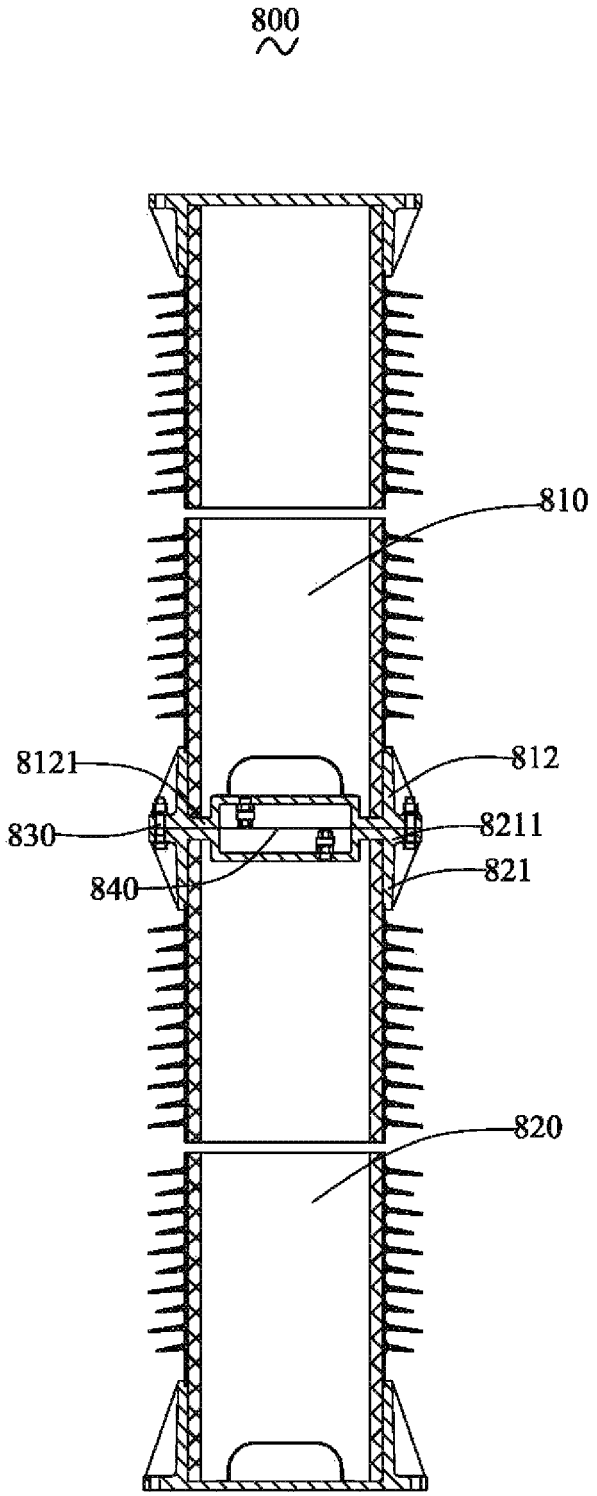
FIG. 10 is a schematic view showing a cross section in a longitudinal direction of an insulated support post 800 according to a first insulated support post embodiment of the present disclosure.

As shown in FIG. 10, an insulated support post 800 in this embodiment includes two post insulators 810 and 820 connected end to end. The post insulators 810 and 820 are post insulators in the aforementioned post insulator embodiments.

In this embodiment, the post insulators disclosed in the aforementioned post insulator embodiments are connected end to end to form the insulated support post 800, which can provide reliable insulation support for large electrical equipment. The interface problem caused by filling solid in the insulated support post is effectively solved. Moreover, the gas leakage problem caused by filling high-pressure gas in the insulated support post can be solved, thereby avoiding detection and maintenance. Meanwhile, it can provide a large margin for micro-water control, and reduce the difficulty of micro-water control and manufacturing.

In this embodiment, the post insulator 810 has the same structure as the post insulator 100 disclosed in the first post insulator embodiment of the present disclosure. The post insulator 820 has the same structure as the post insulator 400 disclosed in the fourth post insulator embodiment of the present disclosure. The same structure of the post insulators 810 and 820 as the post insulators 100 and 400 will not be repeated herein.

The post insulator 810 and the post insulator 820 are post insulators with the same specification. A lower flange 812 of the post insulator 810 is connected to an upper flange 821 of the post insulator 820 correspondingly. Specifically, the lower flange 812 and the upper flange 821 are fixedly connected through bolts 830.

A sealing gasket 840 may be provided between the two post insulators 810 and 820.

In this embodiment, a base 8121 of the lower flange 812 is attached to a base 8211 of the upper flange 821, and the sealing gasket 840 is provided between the base 8121 and the base 8211.

Through providing the sealing gasket 840 between the base 8211 and the base 8121, the sealing performance of the connection between the lower flange 812 and the upper flange 821 can be improved, thereby further ensuring that the insulated support post 800 has a good gas sealing performance.

It should be noted that, in other embodiments, the post insulator of the insulated support post may also be selected from the post insulators in the other post insulator embodiments of the present disclosure. The two post insulators of the insulated support post may be the post insulators disclosed in the same insulator embodiment, or the post insulators disclosed in the different insulator embodiments.

Second Insulated Support Post Embodiment

Figure 11:
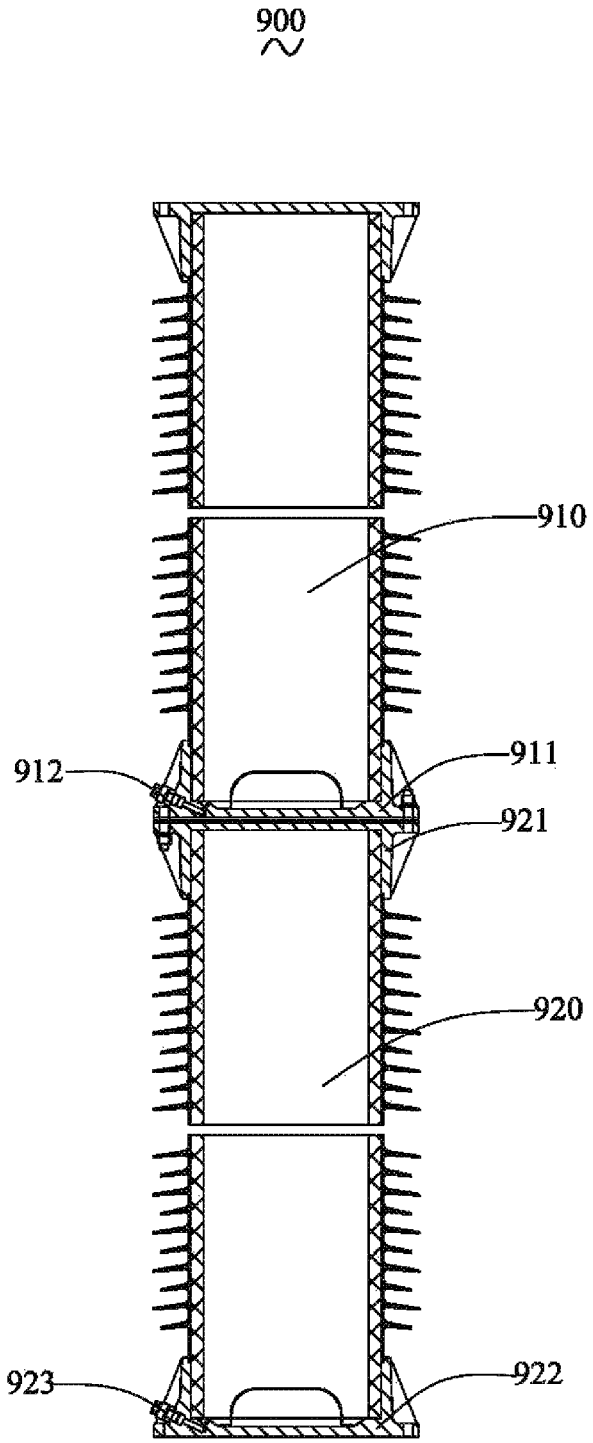
FIG. 11 is a schematic view showing a cross section in a longitudinal direction of an insulated support post 900 according to a second insulated support post embodiment of the present disclosure.

As shown in FIG. 11, an insulated support post 900 in this embodiment has similar structure to that of the insulated support post 800 in the first insulated support post embodiment. The same structure of the insulated support post 900 as the insulated support post 800 will not be repeated herein. The insulated support post 900 differs from the insulated support post 800 in that a post insulator 910 has a same structure as the post insulator 700 in the seventh post insulator embodiment. A post insulator 920 has a same structure as the post insulator 910.

In this embodiment, the post insulator 910 and the post insulator 920 have the same structure, and both the post insulator 910 and the post insulator 920 have the same structure as the post insulator 700 in the seventh post insulator embodiment. Specifically, a lower flange 911 of the post insulator 910 is connected to an upper flange 921 of the post insulator 920.

A self-sealing valve 912 of the post insulator 910 is provided on a flange tube of the lower flange 911. A self-sealing valve 923 of the post insulator 920 is provided on a flange tube of the lower flange 922. When the post insulator 910 is connected to the post insulator 920, the self-sealing valve 912 and the self-sealing valve 923 can still extract gas from an interior of the hollow insulating tube and fill the interior of the hollow insulating tube with the gas, which will not be affected by a structure for connecting the post insulator 910 and the post insulator 920, thereby improving the practicability.

It should be noted that, in other embodiments, the post insulator of the insulated support post may also be selected from the post insulators in other post insulator embodiments of the present disclosure. The two post insulators of the insulated support post may be the post insulators disclosed in the same embodiment, or the post insulators disclosed in the different post insulator embodiments.

The technical solutions and technical features of the present disclosure have been disclosed as above, but it should be understood that under the creative idea of the present disclosure, various changes and modifications to the aforementioned structures and materials can be made by those skilled in the art, which includes a combination of technical features disclosed or claimed separately, obviously further includes other combinations of these features. These modifications and/or combinations all fall within the technical field involved in the present disclosure and fall into the protection scope of the claims of the present disclosure.

What is claimed is:

1. A post insulator comprising:

a hollow insulating tube including opposing first and second ends, wherein the hollow insulating tube is made of an insulating material having a water vapor transmission rate less than or equal to 0.2 $g/m^2 \cdot d$ at a temperature of about 55° C. and a relative humidity of about 90% RH;

a shed positioned on a periphery of the hollow insulating tube;

an upper flange disposed at one of the first and second ends; and a lower flange disposed at another of the first and second ends, wherein gas is sealed inside the hollow insulating tube, and the gas has an absolute pressure in a range of about 0.1 MPa to 0.15 MPa.

2. The post insulator according to claim 1, wherein the gas is selected from the group consisting of dried high-purity nitrogen, air or sulfur hexafluoride gas.

3. The post insulator according to claim 1, wherein at least one of the upper flange and the lower flange includes a self-sealing valve, and wherein the self-sealing valve is adapted to backfill the gas after vacuuming.

4. The post insulator according to claim 3, wherein the lower flange includes a base adapted to seal the hollow insulating tube, and the lower flange includes a flange tube coupled to a wall of the hollow insulating tube, and wherein at least one of the base and the flange tube includes the self-sealing valve.

5. The post insulator according to claim 4, wherein the self-sealing valve is disposed on the base, and wherein the base is disposed towards an interior of the hollow insulating tube to form a recess, such that an opening of the self-sealing valve is positioned inside the recess.

6. The post insulator according to claim 4, wherein the self-sealing valve is disposed on the flange tube, and wherein the flange tube is in communication with the hollow insulating tube via the base.

7. The post insulator according to claim 1, wherein at least one of the upper flange and the lower flange includes a drying device that is disposed inside the hollow insulating tube.

8. The post insulator according to claim 7, wherein the drying device includes a cage-shaped desiccant box, and a desiccant is disposed in the desiccant box.

9. The post insulator according to claim 8, wherein the desiccant box is made of a conductive material, and the desiccant box includes uniformly distributed holes.

10. The post insulator according to claim 8, wherein the desiccant is a molecular sieve desiccant.

11. An insulated support post comprising two post insulators according to claim 1, the two post insulators being connected end to end.

12. The insulated support post according to claim 11, wherein a sealing gasket is provided between the two post insulators.

* * * * *